United States Patent [19]

Hammer et al.

[11] Patent Number: 4,523,126

[45] **Date of Patent: * Jun. 11, 1985**

[54] SHAPED DISCHARGE LAMP WITH STARTING AID

[75] Inventors: Edward E. Hammer, Mayfield Village; Charles E. Beck, Chesterland, both of Ohio

[73] Assignee: General Electric Company, Schenectady, N.Y.

[ * ] Notice: The portion of the term of this patent subsequent to Jul. 31, 2001 has been disclaimed.

[21] Appl. No.: 368,498

[22] Filed: Apr. 15, 1982

[51] Int. Cl.[3] ..... H01J 17/00; H01J 61/00

[52] U.S. Cl. ..... 313/594; 313/634

[58] Field of Search ..... 313/594, 601, 602, 634, 313/234, 607, 492

[56] References Cited

U.S. PATENT DOCUMENTS

| | | | |
|---|---|---|---|
| 2,795,724 | 6/1957 | Beeson | 313/594 |
| 3,548,241 | 12/1970 | Rasch et al. | 313/490 X |
| 4,138,621 | 2/1979 | Downing et al. | 313/113 |
| 4,321,502 | 3/1982 | Hammer et al. | 313/594 |
| 4,422,010 | 12/1983 | Hammer | 313/594 |
| 4,463,280 | 7/1984 | Hammer et al. | 313/594 |
| 4,468,591 | 8/1984 | Hammer et al. | 313/594 |

*Primary Examiner*—David K. Moore

*Attorney, Agent, or Firm*—N. D. Herkamp; Philip L. Schlamp; Fred Jacob

[57] ABSTRACT

A discharge lamp comprising an elongated bulb shaped so that the ends thereof are substantially closer together than if the bulb were straight and containing electrodes respectively near said ends thereof, and a starting air comprising conductive members respectively adjacent to said bulb behind the plane of each of said electrodes, and means electrically interconnecting said conductive members.

7 Claims, 6 Drawing Figures

Fig. 1
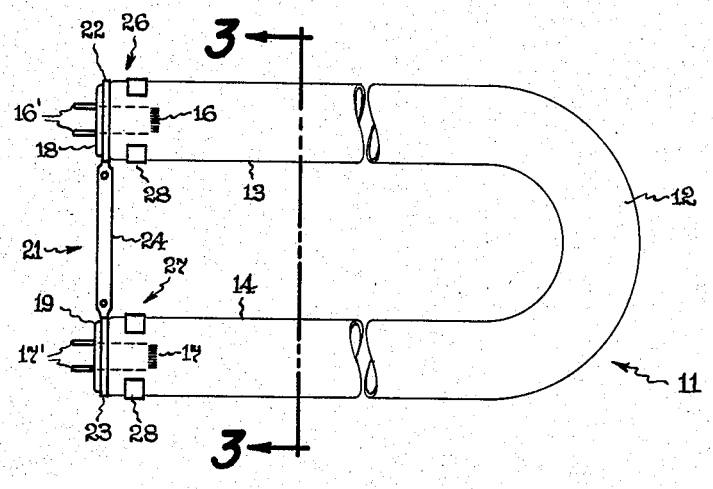
Fig. 2
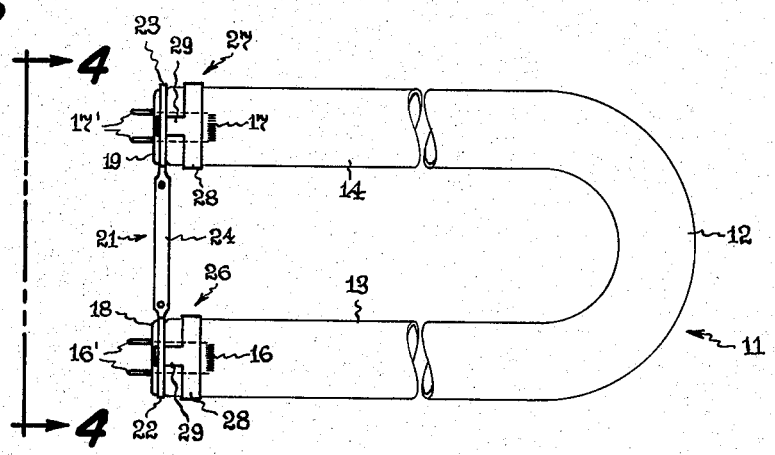
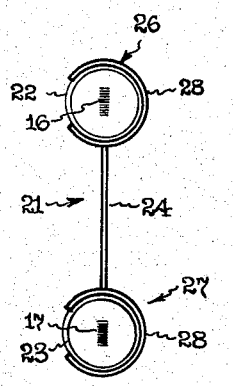
Fig. 3
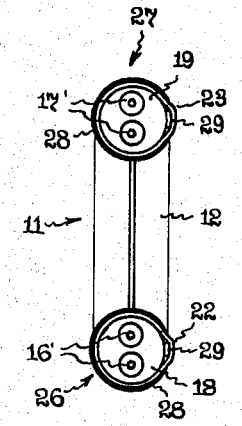
Fig. 4
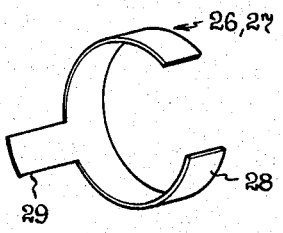
Fig. 5

SHAPED DISCHARGE LAMP WITH STARTING AID

CROSS-REFERENCE TO RELATED APPLICATIONS

Ser. No. 371,143, filed Apr. 23, 1982, Edward E. Hammer, "Shaped Discharge Lamp With Starting Aid", assigned the same as this invention, now U.S. Pat. No. 4,422,010 issued Dec. 20, 1983, a continuation-in-part of Ser. No. 253,089, filed Apr. 13, 1981, Edward E. Hammer, "U-Shaped Discharge Lamp With Starting Aid", assigned the same as this invention, abandoned.

Ser. No. 368,500, filed concurrently herewith, Edward E. Hammer and Charles E. Beck, "Shaped Discharge Lamp With Starting Aid and Starting Strip", assigned the same as this invention, now U.S. Pat. No. 4,468,591 issued Aug. 28, 1984.

Ser. No. 368,499, filed concurrently herewith, Edward E. Hammer and Charles E. Beck, "Starting Aid for Discharge Lamp", assigned the same as this invention, now U.S. Pat. No. 4,463,280 issued July 31, 1984.

BACKGROUND OF THE INVENTION

The invention is in the field of discharge lamps, such as fluorescent lamps, having an elongated bulb shaped so that its ends are substantially closer together than if the bulb were straight, and containing electrodes near the ends of the bulb. Examples of such lamps are U-shaped lamps, circular lamps, double spiral lamps, and half-circle lamps.

U.S. Pat. No. 3,548,241 to Rasch discloses a U-shaped fluorescent lamp construction of the type having a support strap clamped around the ends of the lamp to improve its rigidity. The lamp does not employ a starting aid.

The above-referenced patent application to Hammer is directed to U-shaped discharge lamps having conductive starting aid members respectively adjacent to the lamp bulb in the vicinity of its electrodes, and means electrically interconnecting the starting aid members.

SUMMARY OF THE INVENTION

An object of the invention is to provide an improvement in starting aids for U-shaped lamps and other discharge lamps having an elongated bulb shaped so that its ends are substantially closer together than if the bulb were straight, and to improve the start and restart capabilities of such lamps. The term "restart" means turning the lamp on quickly or soon (within several seconds or minutes) after it turns off. Examples are when the light switch is accidentally turned off and is quickly turned on again, and when the power line voltage dips or goes off momentarily.

The invention comprises, briefly and in a preferred embodiment, a discharge lamp comprising an elongated bulb shaped so that its ends are substantially closer together than if the bulb were straight and containing electrodes respectively near the ends thereof, and a starting aid comprising a pair of conductive means respectively adjacent to said bulb in the vicinity of and behind the plane of said electrodes, and spacially extending means electrically interconnecting said conductive means. The aforesaid interconnecting means may be, or may be combined with, a bulb support strap attached to and extending between the ends of the bulb.

Preferably, the aforesaid conductive means at least partially encircle the bulb legs.

BRIEF DESCRIPTION OF THE DRAWINGS

FIG. 1 is a view of one side of a U-shaped discharge lamp in accordance with a preferred embodiment of the invention.

FIG. 2 is a view of the other side of the lamp of FIG. 1.

FIG. 3 is a cross-sectional view taken on the line 3—3 of FIG. 1.

FIG. 4 is a cross-sectional view taken on the line 4—4 of FIG. 2.

FIG. 5 is a perspective view of a starting aid clip used in a preferred embodiment of the invention, two such clips being employed on a lamp.

DESCRIPTION OF THE PREFERRED EMBODIMENTS

Figure 6:
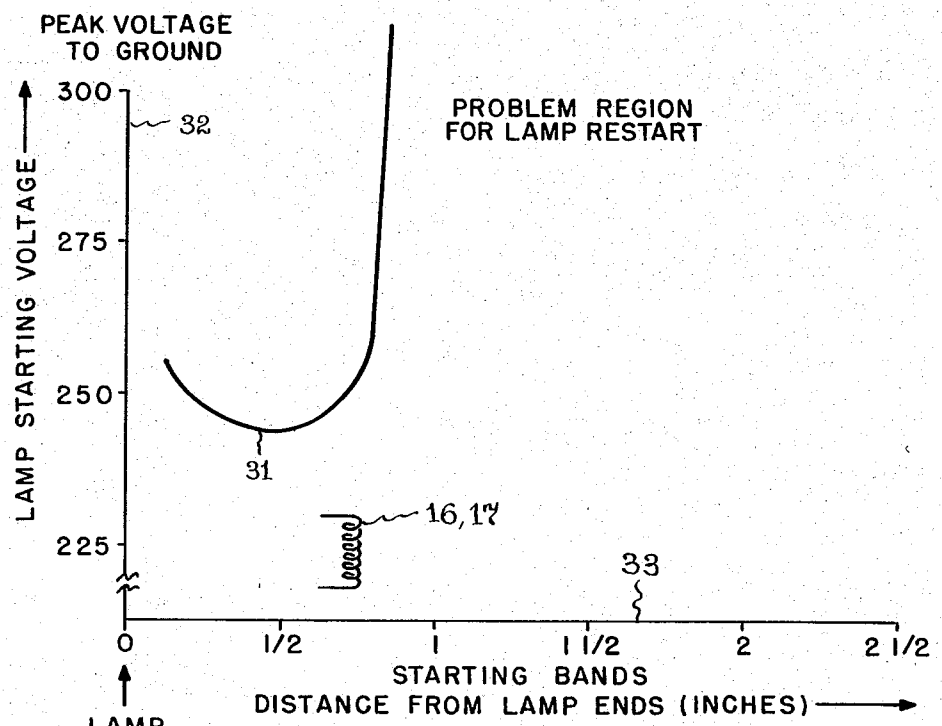
FIG. 6 is a plot of lamp restart voltages of a U-shaped lamp with the starting aids of the invention positioned at various positions along the bulb in the vicinity of the cathodes.

The U-shaped discharge lamp of FIG. 1 comprises a U-shaped bulb 11 having a U-bend portion 12 and a pair of mutually parallel straight legs 13, 14. A pair of cathodes 16 and 17 are respectively mounted in the bulb near the ends thereof, and respectively connected to pairs of the lamp's connector terminals 16' and 17'. A pair of short cylindrical metal end caps 18 and 19 are cemented to the ends of the bulb for supporting the connector terminals 16' and 17' by means of an insulative mounting disc in conventional manner. The endmost regions of the bulb 11, over which the end caps 18, 19 fit, conventionally are "necked down" slightly in diameter from that of the rest of the bulb. In order to mutually brace the ends of the bulb 11, a support strap 21 is provided and comprises circular metal bands 22, 23 respectively tightly encircling the end caps 18 and 19, these bands 22 and 23 being attached to and interconnected by a rigid metal lateral strap 24. The lamp described thus far is generally similar to that disclosed in the above-referenced Rasch patent. Conventionally, bulb 11 is internally coated with a phosphor, and contains a quantity of mercury to provide a mercury vapor discharge path in the lamp. Also, a gas fill such as argon is provided in the bulb to aid in starting, or in more recent energy-saving lamps the fill gas is a mixture of krypton and argon.

In accordance with the invention, a starting aid for the lamp comprises a pair of electrically conductive members 26, 27 respectively adjacent to the bulb in the vicinity of and behind the plane of the lamp's cathode electrodes 16, 17, i.e., between the planes of the cathodes and the ends of the bulb at which end caps 18, 19 are attached. In a preferred embodiment, each of the starting aid conductive members 16, 17 comprises a circular band portion 28 which at least partly surrounds and encircles the bulb and preferably is in contact therewith. The band portions 28 preferably extend at least halfway around the bulb circumference, and may comprise closed loops completely encircling the bulb. The starting aid members 26, 27 are electrically interconnected by spatially extending conductive means, rather than by conductive means extending alongside a major portion of the bulb length. A preferred type of this spatially extending electrical interconnection, which is the subject of the above-referenced patent application Ser. No. 368,499, comprises extension stems 29 integral with and extending from the respective band portions 28; these stems 29 extend respectively under the bracing bands 22, 23 and are securely clamped between these bands and the end caps 18, 19 thus electrically interconnecting the starting aid members 26, 27 via the metal bracing bands 22, 23 and lateral strap 24. The conductive bands 26, 27 may be made of resilient metal so that they clamp snugly onto the bulb, and, alternatively, they and their extending stems 29 can be applied to the bulb in the form of a conductive ink or paint with the stems 29 extending under and contacting the end caps 18, 19.

As has been mentioned above, the above-referenced patent application of Hammer is directed to a U-shaped discharge lamp having electrically interconnected conductive starting aid members respectively at or adjacent to the lamp bulb in the vicinity of the electrodes. These starting aid members, in being in the vicinity of the lamp electrodes, can lie in the plane in which the electrodes lie, or can be ahead of the plane of the electrodes (i.e., at the gas discharge region of the bulb) or behind the plane of the electrodes (i.e., between the plane of the electrodes and the ends of the bulb) up to distances within which they achieve the objective of aiding lamp starting. However, in accordance with a basic concept of the present invention, the starting aids improve restart of the lamps only if they are located behind the plane of the lamp electrodes, and can hinder or prevent restart of the lamps if located ahead of the plane of the electrodes. "Restart" is a condition when the lamp is to be restarted shortly (within several seconds or minutes) after it has turned off, such as when the light switch is accidentally or otherwise turned off and is quickly turned on again within a few minutes, or when the power line voltage momentarily dips or goes off. In accordance with the present invention, the starting aids are located behind the plane of the electrodes and in this position they aid and facilitate restart of the lamps and also aid and facilitate initial start of the lamps. The term "initial start" as used herein means starting the lamp after it has been off for a considerable time such as more than several minutes.

FIG. 6 illustrates the just-described restarting characteristics of lamps provided with starting aids, and is a plot 31 of lamp restart voltage as represented along the vertical coordinate 32 versus location of the starting aids along the legs of the U-shaped bulb as represented along the horizontal coordinate 33. In a typical 35-watt U-shaped lamp, which generally is 22 inches long from its ends to its U-bend, the cathode electrodes 16, 17 are positioned $\frac{3}{4}$ inch from the lamp ends, as indicated in FIG. 6. The restart voltage coordinate 32 is marked with "Peak Voltage to Ground" which is the peak value of a-c starting and restarting voltage applied by the ballast to the lamp electrodes 16, 17.

As shown by the plot 31, the lamp restarts the most readily and reliably, i.e., at the lowest applied voltage, when the starting aid bands 28 are positioned behind the plane of the electrodes 16, 17 and is optimum when the starting bands 28 are about $\frac{1}{4}$ to $\frac{3}{8}$ inch behind the plane of the electrodes. Also, curve 31 shows an abrupt occurrence of a restart problem if the starting bands 28, or any part of them, are positioned ahead of the plane of the electrodes. Thus, locating the starting aid bands 28 behind the plane of the electrodes provides beneficial restart characteristics, in addition to providing beneficial initial start characteristics by being in the vicinity of the electrode plane.

The theory of the invention is believed to be as follows. During lamp operation, the starting aid members 26, 27 (and the interconnecting support strap 21), which are electrically floating, acquire a negative polarity charge due to the electron emissions which alternately occur from the cathodes 16, 17 in functioning to sustain an a-c gas discharge current in the lamp. When the lamp is turned off, this negative charge remains on the members 26, 27 for a time until it dissipates or drains off, usually during a period of several seconds or minutes, this time depending on conditions of the lamp and surrounding air; if the glass bulb is clean and the air is dry the time will be relatively long, and if the bulb is dirty and/or moist and the air is humid the time will be relatively short. If it is attempted to turn the lamp on during this time period of residual negative charge on the starting aid bands 26, 27, and if these bands are positioned ahead of the electrodes 16, 17, the lamp may not restart until the negative charge on the starting aid bands dissipates or drains off. This undesired delay in restart is indicated by the "Problem Region for Lamp Restart" in FIG. 6, and is probably due to the negative charge of the starting bands repelling electrons emitted from the electrodes 16, 17 and preventing them from entering the gas discharge region sufficiently to initiate a gas discharge for restarting the lamp. When, however, the starting aid bands 26, 27 are positioned behind the plane of the electrodes, in accordance with the invention, the lamp restarts readily and the restart is actually facilitated because the negative charge of the starting aid bands repels electrons emitted from the electrodes 16, 17 in directions toward the gas discharge region, thus facilitating establishment of the gas discharge and hence starting of the lamp. The starting aid bands 26, 27 may be, for example, about $\frac{1}{4}$- to $\frac{3}{8}$-inch wide and positioned about $\frac{1}{4}$ to $\frac{1}{2}$ inch behind the plane of the electordes 16, 17.

The starting aid of the invention can be used advantageously on various types of discharge lamps which have an elongated bulb shaped so that its ends are substantially closer together than if the bulb were straight. Although the invention has been particularly described as applied to a U-shaped lamp bulb, it can similarly be applied to a circular bulb having its ends relatively close together, and to bulbs having a semi-circular shape, and also bulbs having a double-spiral configuration, and other bulbs shaped to have their ends substantially closer together than if the bulbs were straight. The invention is particularly useful on high efficiency discharge lamps containing krypton gas which causes the lamps to be more difficult to start and restart.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A discharge lamp comprising an elongated bulb shaped so that its ends are substantially closer together than if the bulb where straight and containing electrodes respectively near said ends thereof, and a starting aid comprising conductive means disposed respectively adjacent to respective ends of said bulb and completely behind the plane of said electrodes with respect to the discharge path, and spatially extending means electrically interconnecting said conductive means.

2. A lamp as claimed in claim 1, in which said bulb is U-shaped and having a pair of parallel legs, and in which said interconnecting means comprises a conductive member extending between said pair of parallel legs near said ends thereof.

3. A lamp as claimed in claim 2, in which said lamp includes a support means extending across the ends of the bulb, said support means comprising said interconnecting means.

4. A lamp as claimed in claim 3, in which said starting aid conductive means comprises a pair of conductive bands respectively extending around at least part of the circumference of said bulb, and in which said support means comprises a pair of bracing bands respectively encircling the end regions of said bulb, said starting aid bands comprising extension stems respectively extending beneath and clamped by said bracing bands.

5. A lamp as claimed in claim 1, in which said starting aid conductive means comprises a pair of conductive bands respectively extending around at least half of the circumference of said bulb.

6. A lamp as claimed in claim 1, in which said lamp is provided with a gas fill comprising krypton.

7. A lamp as claimed in claim 6, in which said gas fill further comprises argon and mercury.

* * * * *